US010927548B1

(12) United States Patent
Abbas et al.

(10) Patent No.: US 10,927,548 B1
(45) Date of Patent: Feb. 23, 2021

(54) FIBER ELEMENTS FOR SOIL STABILIZATION

(71) Applicant: KING SAUD UNIVERSITY, Riyadh (SA)

(72) Inventors: Husain Abbas, Riyadh (SA); Abdullah A. Almajed, Riyadh (SA); Tarek H. Almusallam, Riyadh (SA); Yousef A. Al-Salloum, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/796,922

(22) Filed: Feb. 20, 2020

(51) Int. Cl.

| | |
|---|---|
| ***E04C 5/00*** | (2006.01) |
| ***E04C 5/07*** | (2006.01) |
| ***E02D 3/00*** | (2006.01) |
| *E01C 21/00* | (2006.01) |

(52) U.S. Cl.
CPC ..... *E04C 5/073* (2013.01); *E02D 3/005* (2013.01); *E01C 21/00* (2013.01)

(58) Field of Classification Search
CPC . E01C 21/00; E01C 3/04; E02D 3/005; C04B 20/0008; E04C 5/073; E04C 5/012
See application file for complete search history.

(56) References Cited

U.S. PATENT DOCUMENTS

| | | | | |
|---|---|---|---|---|
| 2,677,955 | A * | 5/1954 | Constantinesco | E04C 5/012 428/221 |
| 3,616,589 | A | 11/1971 | Sherard | |
| 4,067,197 | A | 1/1978 | Ritter | |
| 4,662,946 | A * | 5/1987 | Mercer | C04B 16/12 106/284.01 |
| 5,145,285 | A * | 9/1992 | Fox | E02D 3/08 106/900 |
| 5,858,082 | A * | 1/1999 | Cruz | C04B 14/48 106/644 |
| 6,197,401 | B1 | 3/2001 | Ahn | |
| 10,030,391 | B2 * | 7/2018 | Hattar | E01C 11/165 |
| 10,563,403 | B1 * | 2/2020 | Almusallam | E04C 5/073 |
| 10,563,404 | B2 * | 2/2020 | Czintos | E04C 5/012 |

FOREIGN PATENT DOCUMENTS

| | | | |
|---|---|---|---|
| CN | 104640436 | A | 5/2015 |
| CN | 106522192 | A | 3/2017 |
| CN | 106630820 | A | 5/2017 |
| EP | 0132254 | A2 | 1/1985 |
| WO | 0155046 | A2 | 8/2001 |

* cited by examiner

*Primary Examiner* — Carib A Oquendo
(74) *Attorney, Agent, or Firm* — Nath, Goldberg & Meyer; Richard C. Litman

(57) ABSTRACT

The fiber elements for soil stabilization include a combination of rigid and flexible fibers that are adapted to be added to soil in order to stabilize the soil to improve the geotechnical characteristics thereof. Each fiber element includes a rigid fiber having opposed first and second ends, at least the first end defining a first ring. A plurality of flexible fibers are attached to the first ring. When mixed with soil, the rigid fibers provide stiffness to the soil mass, and the flexible fibers provide deformability. For purposes of packaging, prior to addition to soil, the plurality of flexible fibers may be at least partially secured to one another by a water soluble material, such as a water soluble glue, water soluble thread or the like. A plurality of the fiber elements may be secured to one another by the water soluble material, forming a fiber module.

8 Claims, 4 Drawing Sheets

FIBER ELEMENTS FOR SOIL STABILIZATION

BACKGROUND

1. Field

The disclosure of the present patent application relates to soil treatment, and particularly to fiber elements for soil stabilization that are added to soil to stabilize the soil to improve the geotechnical characteristics thereof.

2. Description of the Related Art

Prior to the construction of buildings, pavement, structures, and the like, it is common to first stabilize the ground soil in order to improve the geotechnical characteristics of the soil, such as shear strength, settlement/consolidation, slope stability, soil retention, etc. Soil stabilization techniques are broadly classified as either chemical techniques or mechanical techniques. Chemical stabilization of soil is typically performed by in situ mixing and surface stabilization using lime, cement, fly ash, bottom ash, bentonite, gypsum, silica fume, blast furnace slag, and the like. The most common mechanical techniques include soil replacement, preloading, the addition of stone columns, soil nailing, the addition of fibers, and synthetic reinforcement.

Reinforcement of the soil using fibers is a relatively common technique used to improve the physical and mechanical properties of the soil. A variety of both synthetic and natural fibers have been employed for decades as reinforcement materials mixed randomly into the soil. Although natural fibers are environmental friendly, energy efficient and effective for some purposes, they typically suffer from poor durability and are prone to degradation over time. Additionally, natural fibers tend to be hydrophilic, which is not a desirable property when mixed with soil. Although numerous types of synthetic fibers have been used for reinforcing soil, they are typically relatively inefficient when compared with natural fibers, particularly due to their tendency to agglomerate and clump together. Due to the drawbacks inherent in presently used natural and synthetic fibers, it would obviously be desirable to be able to provide fibers with the desirable properties of synthetic fibers (such as not being hydrophilic, for example), but which are free from agglomeration and the like. Thus, fiber elements for soil stabilization solving the aforementioned problems are desired.

SUMMARY

The fiber elements for soil stabilization includes combinations of rigid and flexible fibers that are adapted to be added to soil in order to stabilize the soil to improve the geotechnical characteristics thereof. Each fiber element includes a rigid fiber having opposed first and second ends, where at least the first end defines a ring. A plurality of flexible fibers are attached to the ring, either as closed loops extending through the ring or as open fibers tied to the ring. When mixed with soil, the rigid fibers provide stiffness to the soil mass, and the flexible fibers provide deformability. The combination of rigid and flexible fibers behaves as a structural mesh that holds the soil mass together, thus increasing the soil structural integrity. For purposes of packaging, prior to addition to the soil, the plurality of flexible fibers may be at least partially adhered or attached to one another by a water soluble material, such as a water soluble glue, water soluble thread or the like. When added to soil containing moisture, the water soluble material absorbs moisture from the soil, dissolves and releases the flexible fibers so that they are free to open up and flex with respect to the rigid fiber.

Each flexible fiber may define a closed loop, such that each closed loop interlinks with the ring of the rigid fiber. Alternatively, each flexible fiber may be provided with opposed first and second ends, where the first end is attached to the ring of the rigid fiber, and the second end is free.

Alternatively, the second end of the rigid fiber may also define a ring, such that a, plurality of flexible fibers may also be attached to the ring at the second end of the rigid fiber. Similar to the previous embodiment, the plurality of flexible fibers may be at least partially adhered to one another by water soluble adhesive or attached to each other by water soluble thread. Additionally, similar to the previous embodiment, the flexible fibers at the second end of the rigid fiber may define a closed loop, or alternatively, may have opposed first and second ends, where the first end of the flexible fiber is attached to the ring at the second end of the rigid fiber, and the second end of the flexible fiber is free.

In a further alternative embodiment, fiber modules are provided for soil stabilization. Each of the fiber modules is formed from a plurality of the fiber elements, as described above, the fiber elements being bonded to one another by the water soluble adhesive or attached together by water soluble thread.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
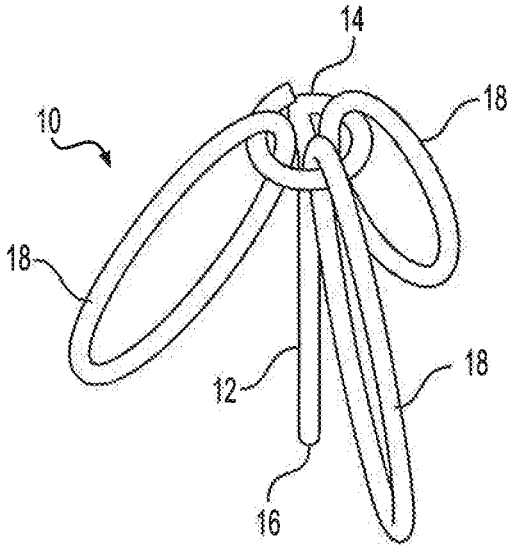
FIG. 1 is a perspective view of an exemplary fiber element for soil stabilization having flexible fibers in discrete loops attached to a ring at one end of a stiff fiber.

The fiber elements for soil stabilization 10 includes combinations of rigid and flexible fibers that are adapted to be added to soil in order to stabilize the soil to improve the geotechnical characteristics thereof. FIG. 1 illustrates an exemplary single fiber element 10. However, it should be understood that the fiber elements for soil stabilization 10 will typically be provided in a relatively large quantity, due to their use as a homogeneously and randomly mixed agent for soil. For purposes of simplification and illustration, FIG. 1 only shows a single exemplary fiber element 10 for soil stabilization. As shown in FIG. 1, the fiber element 10 for soil stabilization includes a rigid fiber 12 having opposed first and second ends 14, 16, respectively, where, in this case, the first end 14 defines a ring. It should be understood that the ring formed at first end 14 is shown for exemplary purposes only, and that the first end 14 may be formed as any suitable type of closed ring or closed loop having any suitable dimensions and configuration.

Further, it should be understood that rigid fiber 12 is shown for exemplary purposes only and may have any suitable dimensions and configuration. Although shown as having a simple circular cross section and shown as being formed from a uniform piece of material, it should be understood that the rigid fiber 12 may have any suitable cross-sectional configuration. Examples of alternative configurations include braided fibers, crimped fibers, twisted fibers, nonlinear fibers such as sinusoidal or the like), and circular, rectangular, or twisted cross sections. Further, it should be understood that the rigid fiber 12 may be formed from any suitable stiff or rigid material. For example, the rigid fiber 12 may be formed from steel. The rigid fiber 12 may, for example, have a length ranging from approximately 4 mm to approximately 60 mm, and a diameter ranging from a fraction of a millimeter to approximately 5 mm.

A plurality of flexible fibers 18 are attached to the ring at the first end 14 of the rigid fiber 12. When mixed with soil, the rigid fibers 12 provide stiffness to the soil mass, and the flexible fibers 18 provide deformability. The combination of rigid and flexible fibers 12, 18 behaves as a structural mesh that holds the soil mass together, thus increasing the soil structural integrity. It should be understood that the flexible fibers 18 may be formed from any suitable type of flexible material, for example, polypropylene, polyester, polyvinyl alcohol (PVA), fabric or the like. Further, although FIG. 1 shows three such flexible fibers 18 attached to the ring at the first end 14, it should be understood that any suitable number of flexible fibers 18 may be used. Preferably, three or more flexible fibers 18 are included. The use of a number of flexible fibers 18 connected to the rigid fiber stem 12 keeps relatively large soil masses together when in use. Additionally, although steel is given as an example of a rigid material for the rigid fiber 12, it should be understood that the rigid fiber 12 may be formed from the same material as the flexible fibers 18, but made thicker to increase its stiffness. The diameter of the flexible fibers 18 may be the same as that of the rigid fiber 12, or may be less than the diameter of the rigid fiber 12. The length or circumference of the flexible fiber 18 may be approximately twice the length of the rigid fiber 12.

Figure 2:
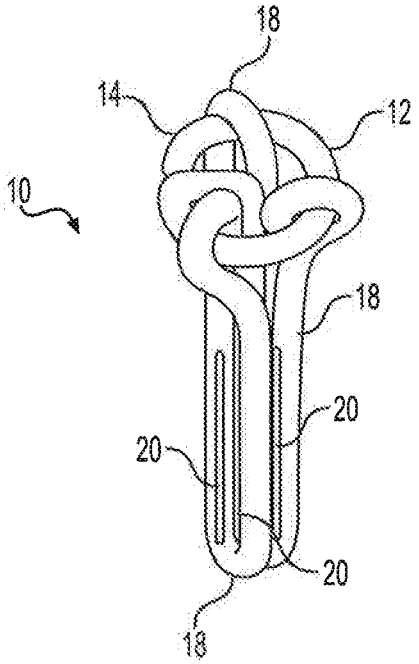
FIG. 2 is a perspective view of an exemplary fiber element for soil stabilization having the flexible fibers adhered to each other and to the stiff fiber.

As shown in FIG. 2, for purposes of packaging, prior to addition to the soil, the plurality of first flexible fibers 18 may be at least partially adhered or attached to one another and held against the rigid fiber 12 by a fastening material, which is a water soluble material, such as a water soluble glue 20, water soluble thread, or the like. The flexible fibers 18 may, alternatively, be secured to the rigid fiber 12 by the water soluble material 20, or may be secured to both the rigid fiber 12 and to each other by the water soluble material 20. When added to soil containing moisture, the water soluble material 20 absorbs moisture from the soil, dissolves and releases the first flexible fibers 18 so that they are free to move and flex with respect to the rigid fiber 12.

Figure 3:
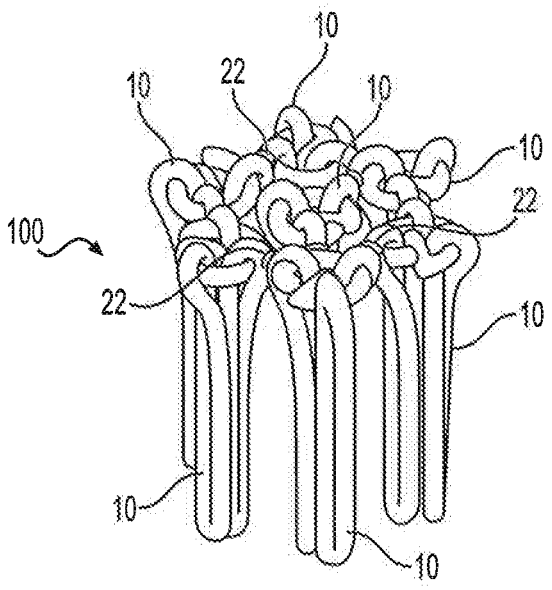
FIG. 3 is a perspective view of a fiber module formed from a plurality of the fiber elements of FIG. 2 (although shown with a gap between groups of flexible fibers for clarity, the gap is zero and the flexible fibers are glued together)

As shown in FIG. 3, a fiber module 100 may be formed by attaching a plurality of the fiber elements 10 of FIG. 2 to one another using water soluble material 22. Thus, when the fiber modules 100 are added to soil containing moisture, the water soluble material 22 absorbs moisture from the soil, which dissolves and releases the plurality of fiber elements 10. The water soluble material 20 of each fiber element 10 also dissolves, releasing the flexible fibers 18 so that they are free to move and flex with respect to the corresponding rigid fibers 12. The fiber modules 100 may, alternatively, also be formed by attaching fiber elements 10 such that the first end 14 of the rigid fiber 12 of one fiber element 10 is connected to the second end 16 of rigid fiber 12 of the adjoining fiber element 10.

Figure 4:
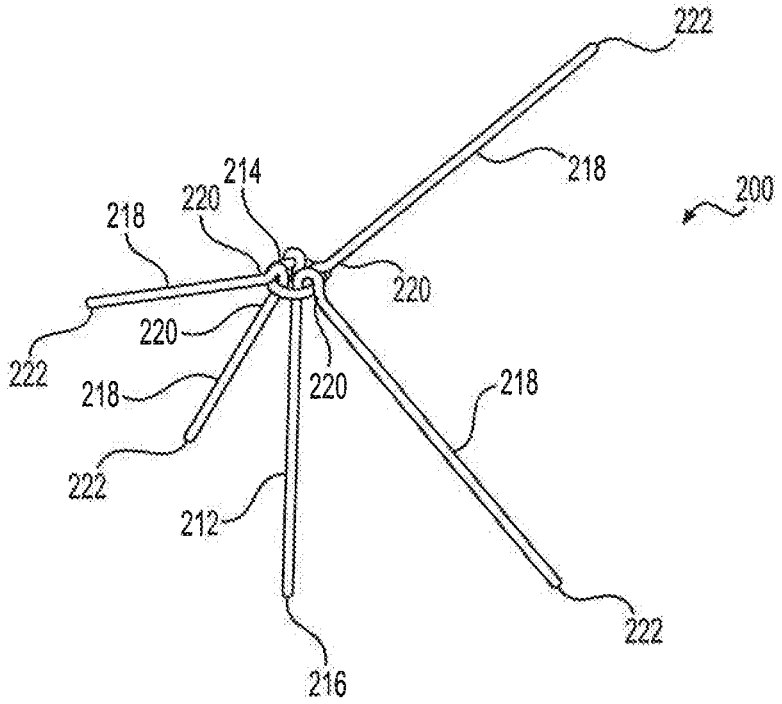
FIG. 4 is a perspective view of an alternative embodiment of a fiber element for soil stabilization in which the flexible fibers have one end attached to a ring of the stiff fiber and the other end free.

Although the flexible fibers 18 are shown as closed loops with a regular shape in FIG. 1, it should be understood that the flexible fibers 18 may have any suitable shape. In the alternative embodiment of FIG. 4, each fiber element 200 for soil stabilization includes a rigid fiber 212 having opposed first and second ends 214 and 216, respectively, where the first end 214 defines a ring, similar to the previous embodiment. However, in the embodiment of FIG. 4, each flexible fiber 218 has opposed first and second ends 220, 222, respectively, where the first end 220 is attached to the ring at the first end 214 of the rigid fiber 212, and the second end 222 is free. Although shown as being substantially linear, it should be understood that each flexible fiber 218 may be crimped, twisted or the like. Further, it should be understood that the flexible fibers 218 may be joined to one another by a water soluble material, such as that described above with regard to FIG. 2, and that fiber elements 200 may be joined together by a water soluble material to form a fiber module, such as that described above with regard to FIG. 3.

Figure 5:
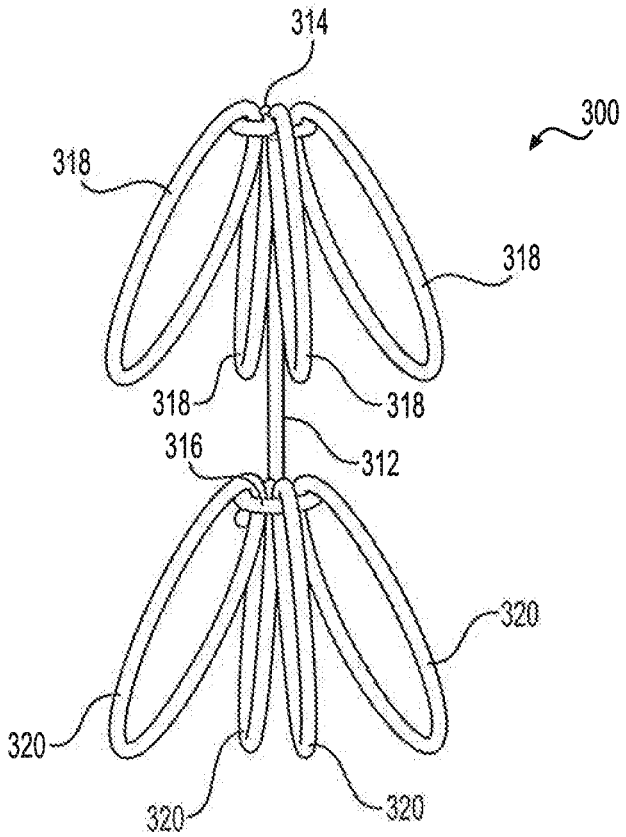
FIG. 5 is a perspective view of another alternative embodiment of a fiber element for soil stabilization, the stiff fiber having rings at both ends and flexible fibers attached to both rings.

In the further alternative embodiment of FIG. 5, each fiber element for soil stabilization 300 includes a rigid fiber 312 having opposed first and second ends 314, 316, and the rigid fiber 312 has a ring at both the first end 314 and the second end 316. As in the previous embodiments, a plurality of flexible fibers 318 are attached to the ring at the first end 314, and a plurality of flexible fibers 320 are also attached to the ring at the second end 316. It should be understood that the flexible fibers 318 at the first end 314 and the flexible fibers 320 at the second end 316 may be joined to one another by a water soluble material, such as that described above with regard to FIG. 2, and that fiber elements 300 may be joined together by a water soluble material to form a fiber module, such as that described above with regard to FIG. 3.

Figure 6:
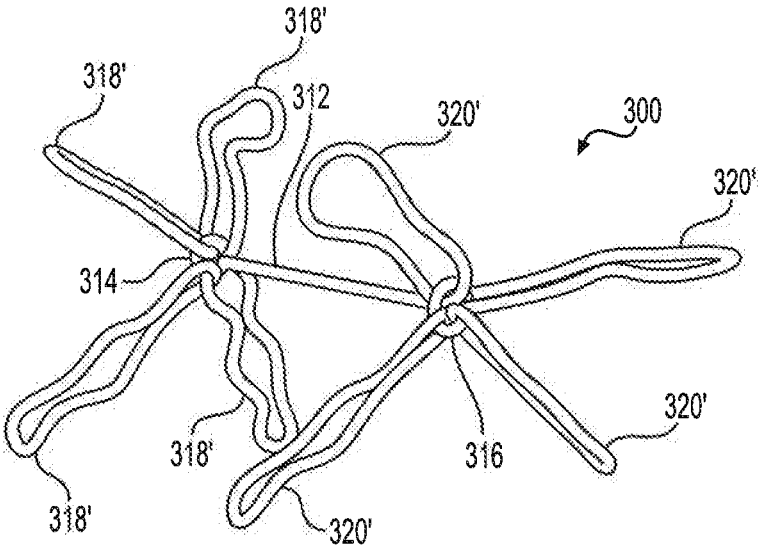
FIG. 6 is a perspective view of still another alternative embodiment of a fiber element for soil stabilization, the flexible fibers having lost or not having a regular shape.
Figure 7:
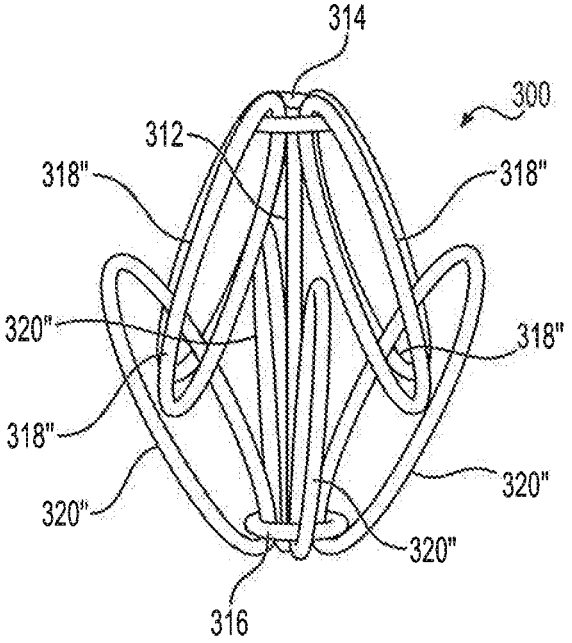
FIG. 7 is a perspective of yet another alternative embodiment of the fiber element for soil stabilization.

Further, as described above with respect to the previous embodiments, it should be understood that the flexible fibers 318, 320 may have any suitable shape. For example, the flexible fibers 318', 320' of FIG. 6 are still shown as being closed loops, but without a regular shape; i.e., the each of the closed loops is twisted and bent. It should be understood that this irregular shape may appear in the flexible fibers described above with respect to the previous embodiments. Further, it should be understood that since the flexible fibers are free to move about the respective first and second rings at the first and second ends 314, 316 of the rigid fiber 312, the orientations of the flexible fibers 318, 320 (318', 320') are shown in FIGS. 5 and 6 for exemplary purposes only. For example, FIG. 7 shows a plurality of flexible fibers 318" attached to the first end 314 and a plurality of flexible fibers 320" attached to the second end 316 of the rigid fiber 312, each flexible fiber loop being oriented such that the arcs 180° opposite the rings they are attached to face the respective opposed end of the rigid fiber 312.

Figure 8:
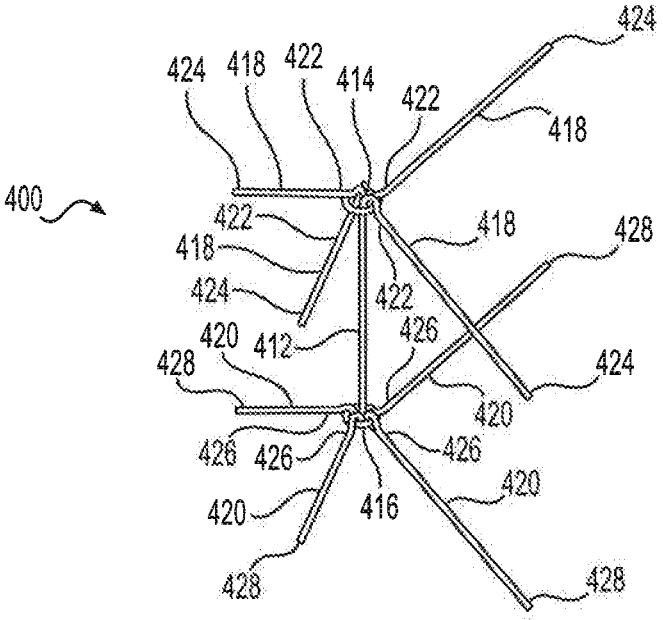
FIG. 8 is a perspective view of a further alternative embodiment of the fiber element for soil stabilization.

Further, similar to that described above with regard to FIG. 4, it should be understood that the flexible fibers may have any suitable shape, including non-looped configurations. In the alternative embodiment of FIG. 8, each fiber element 400 for soil stabilization includes a rigid fiber 412 having opposed first and second ends 414 and 416, respectively, the rigid fiber 412 having a ring at the first end 414 and also a ring at the second end 416, similar to the previous embodiments. However, in the embodiment of FIG. 8, each flexible fiber 418 has opposed first and second ends 422 and 424, respectively, where the first end 422 is attached to the ring at the first end 414 of the rigid fiber 412 and the second end 424 of the flexible fiber 418 is an open free and, similarly, each flexible fiber 420 attached to the ring at the second end 416 of the rigid fiber 412 has opposed first and second ends 426 and 428, respectively, the first end 426 being attached to the ring at the second end 416 and the second end 428 being open and free. Although shown as being substantially linear, it should be understood that each first flexible fiber 418 and second flexible fiber 420 may be crimped, twisted or the like. Further, it should be understood that the flexible fibers 418 and the flexible fibers 420 may be joined to one another by a water soluble material, such as that described above with regard to FIG. 2, and that fiber elements 400 may be joined together by a water soluble material to form a fiber module, such as that described above with regard to FIG. 3.

In the previously described embodiments, it should be understood that each fiber element (or fiber module) may be added to dry soil, which contains insufficient moisture to dissolve the water soluble material. If such is the case, the fiber elements (or fiber modules) may first be added to water to dissolve the water soluble material, thereby opening the flexible fiber loops (i.e., separating the closed loops from each other and from the stiff fiber) so that they may assume a random configuration, and then be dried prior to mixing with the dry soil, the mixture of rigid and flexible fibers forming a mesh reinforcing the soil.

It is to be understood that the fiber elements for soil stabilization are not limited to the specific embodiments described above, but encompass any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A fiber module for soil stabilization, comprising a plurality of fiber elements secured to one another by a water soluble fastening material, wherein each said fiber element comprises:

a single rigid fiber having opposed first and second ends, at least the first end defining a ring, wherein the rigid fiber has a first stiffness; and a plurality of flexible fibers attached to the ring at the first end of the rigid fiber, wherein each of the plurality of flexible fibers has a second stiffness, the second stiffness being less than the first stiffness, further wherein each of the plurality of flexible fibers defines a closed loop, each closed loop defining opposed first and second ends, the first end being attached to the ring, at the first end of the rigid fiber, the second end of the flexible fiber being free.

2. The fiber module for soil stabilization as recited in claim 1, further comprising a water soluble material at least partially attaching the flexible fibers to one another.

3. The fiber module for soil stabilization as recited in claim 1, wherein the second end of the rigid fiber also defines a ring.

4. The fiber module for soil stabilization as recited in claim 3, further comprising a plurality of flexible fibers attached to the ring at the second end of said rigid fiber.

5. The fiber module for soil stabilization as recited in claim 1, further comprising a water soluble fastener attaching said flexible fibers to the rigid fiber, the water soluble fastener dissolving in moist soil so that said flexible fibers assume random configurations linked to the ring at the first end of said rigid fiber.

6. The fiber module for soil stabilization as recited in claim 1, further comprising a water soluble fastener attaching said flexible fibers to each other, the water soluble fastener dissolving in moist soil so that said flexible fibers assume random configurations linked to the ring at the first end of said rigid fiber.

7. The fiber module for soil stabilization as recited in claim 1, wherein said rigid fiber comprises steel fiber.

8. The fiber module for soil stabilization as recited in claim 1, wherein each said flexible fiber is made from a synthetic polymer selected from the group consisting of polypropylene, polyester, polyvinyl alcohol (PVA), and synthetic fabric.

* * * * *